US010579083B1

(12) United States Patent
Gonapati et al.

(10) Patent No.: US 10,579,083 B1
(45) Date of Patent: Mar. 3, 2020

(54) MANAGING LINEAR REGULATOR TRANSIENT VOLTAGES UPON SLEEP TRANSITIONS

(71) Applicant: Synaptics Incorporated, San Jose, CA (US)

(72) Inventors: Kishan Reddy Gonapati, Andhrapradesh (IN); Aswani Aditya Kumar Tadinada, Telangana (IN); Manoja Dangeti, Gachibowli (IN)

(73) Assignee: SYNAPTICS INCORPORATED, San Jose, CA (US)

( * ) Notice: Subject to any disclaimer, the term of this patent is extended or adjusted under 35 U.S.C. 154(b) by 0 days.

(21) Appl. No.: 16/206,990

(22) Filed: Nov. 30, 2018

(30) Foreign Application Priority Data

Sep. 17, 2018 (IN) ..... 201841034921

(51) Int. Cl.
*G05F 1/575* (2006.01)

(52) U.S. Cl.
CPC ..... *G05F 1/575* (2013.01)

(58) Field of Classification Search
CPC ..... H02M 3/155–158; H02M 3/1584; H02M 3/1588; G05F 1/46; G05F 1/462; G05F 1/577; Y02B 70/1466; H05B 37/02; H05B 37/029; H05B 37/0254; H05B 37/3927
USPC ..... 323/282, 285, 288; 315/291, 293, 297, 315/299, 307, 308
See application file for complete search history.

(56) References Cited

U.S. PATENT DOCUMENTS 5,428,268 A * 6/1995 Melis ..... H05B 41/2888 315/247
6,188,181 B1 * 2/2001 Sinha ..... H05B 37/0254 315/293
7,109,668 B2 * 9/2006 Pogodayev ..... H05B 41/245 315/224
2014/0320037 A1 * 10/2014 Mednik ..... H05B 33/0815 315/240
2018/0095488 A1 * 4/2018 Tadinada ..... G05F 1/575

* cited by examiner

*Primary Examiner* — Yemane Mehari
(74) *Attorney, Agent, or Firm* — Paradice & Li LLP

(57) ABSTRACT

An electronic system having a linear voltage regulator and method of operating the linear voltage regulator. A linear voltage regulator of an electronic system has at least three ballast devices. The method of operating includes producing a voltage at an output terminal that is electrically coupled to a node of a first one of the three or more ballast devices; receiving a power mode indication; activating a first additional ballast device of the linear voltage regulator to add first additional capacitance to a load corresponding to the power mode; generating one or more successively delayed ballast control signals based at least in part on the power mode indication; and activating, using the successively delayed ballast control signals, second additional ballast devices of the linear voltage regulator to add second capacitances to the load of the linear voltage regulator.

18 Claims, 11 Drawing Sheets

MANAGING LINEAR REGULATOR TRANSIENT VOLTAGES UPON SLEEP TRANSITIONS

CROSS REFERENCE TO RELATED APPLICATIONS

This application claims priority under 35 U.S.C. 119(b) to co-pending and commonly owned Indian Patent Application No. 201841034921 entitled "MANAGING LINEAR REGULATOR TRANSIENT VOLTAGES UPON SLEEP TRANSITIONS" filed on Sep. 17, 2018, the entirety of which is incorporated by reference herein.

TECHNICAL FIELD

The present embodiments relate generally to linear regulators, and specifically to managing linear regulator transient voltages upon sleep transitions.

BACKGROUND OF RELATED ART

Many electronic systems control on-chip voltages from external power supply sources using linear dropout regulators (LDOs) formed of transistors and capacitors rather than inductors. Such low-dropout regulators serve as direct current (DC) linear voltage regulators that can regulate the output voltage even when the supply voltage is very close to the output voltage.

LDOs have become available for use in on-chip circuitry. Bringing LDOs on-chip has the desirable effect of reducing parts counts, reducing chip I/O (input/output or IO) count, and improving reliability of the electronic system 100. However, on-chip LDOs introduce several undesirable characteristics. Specifically, because these on-chip LDOs use transistors and small capacitors rather than relatively large inductive components and relatively large capacitive components, during operation, these on-chip LDOs introduce undesired voltage transients or ripples at their outputs. When the load on the LDO is small, the voltage swings during rippling can oscillate through overshoots and undershoots—sometimes undershooting to a voltage level well below brownout voltages. As a result, circuitry powered by the LDO may exhibit unwanted behavior (e.g., spontaneously resetting) when the rippling voltage drops below the brownout voltages of the downstream circuit components.

In certain electronic systems, portions of the electronic system 100 including the LDOs can be powered down or placed in a low-power mode during periods when portions of the electronic system 100 are inactive, such as when in a sleep, or dormant, or hibernating mode. Switching between such modes may cause the LDOs to exhibit the unwanted transients described above. Such transients may cause downstream circuitry to receive voltages below their brownout voltages, which in turn can cause such circuitry to fail. Thus, it may be desirable to eliminate or mitigate voltage transients that occur at the outputs of the LDO regulators when changing power modes.

SUMMARY

This Summary is provided to introduce, in a simplified form, a selection of concepts that are further described below in the Detailed Description. This Summary is not intended to identify key features or essential features of the claims subject matter, nor is it intended to limit the scope of the claimed subject matter.

In one aspect, a linear voltage regulator configured with at least one first ballast device and a plurality of additional ballast devices that are individually controlled by respective ballast control signals. The linear voltage regulator includes a power control module configured to receive a power mode indication having at least a first mode and a second mode, and to produce a plurality of successively delayed ballast control signals based at least in part on the power mode indication. In another aspect, a method of operating three or more ballast devices of a linear voltage regulator includes (1) producing a voltage at an output terminal that is electrically coupled to a node of a first one of the three or more ballast devices; (2) receiving a power mode indication; (3) activating a first additional ballast device of the linear voltage regulator to add first additional capacitance to a load corresponding to the power mode; (4) generating one or more successively delayed ballast control signals based at least in part on the power mode indication; and (5) activating, using the successively delayed ballast control signals, second additional ballast devices of the linear voltage regulator to add second capacitances to the load of the linear voltage regulator.

BRIEF DESCRIPTION OF THE DRAWINGS

The present embodiments are illustrated by way of example and are not intended to be limited by the figures of the accompanying drawings.

DETAILED DESCRIPTION

Figure 1A:
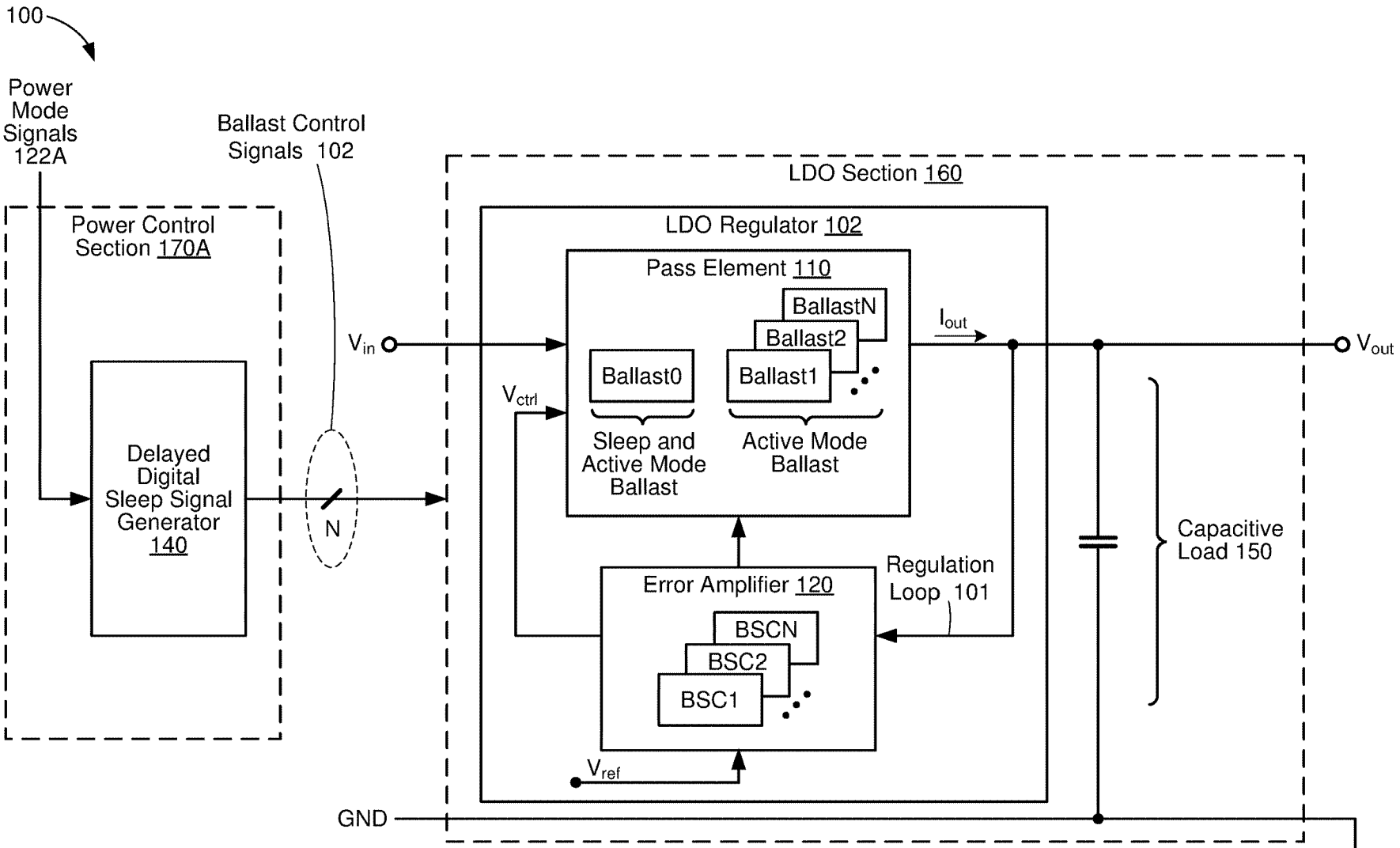
FIG. 1A is a block diagram of an electronic system 100 having an LDO regulator 102 in combination with a delayed digital sleep signal generator, in accordance with some embodiments.

In the following description, numerous specific details are set forth such as examples of specific components, circuits, and processes to provide a thorough understanding of the present disclosure. The term "coupled" as used herein means connected directly to or connected through one or more intervening components or circuits. Also, in the following description and for purposes of explanation, specific nomenclature is set forth to provide a thorough understanding of the aspects of the disclosure. However, it will be apparent to one skilled in the art that these specific details may not be required to practice the example embodiments. In other instances, well-known circuits and devices are shown in block diagram form to avoid obscuring the present disclosure. Some portions of the detailed descriptions that follow are presented in terms of procedures, logic blocks, processing, and other symbolic representations of operations on data bits within a computer memory. The interconnection between circuit elements or software blocks may be shown as buses or as single signal lines. Each of the buses may alternatively be a single signal line, and each of the single signal lines may alternatively be buses, and a single line or bus may represent any one or more of a myriad of physical or logical mechanisms for communication between components.

Unless specifically stated otherwise as apparent from the following discussions, it is appreciated that throughout the present application, discussions utilizing the terms such as "accessing," "receiving," "sending," "using," "selecting," "determining," "normalizing," "multiplying," "averaging," "monitoring," "comparing," "applying," "updating," "measuring," "deriving" or the like refer to the actions and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The techniques described herein may be implemented in hardware, software, firmware, or any combination thereof, unless specifically described as being implemented in a specific manner. Any features described as modules or components may also be implemented together in an integrated logic device or separately as discrete but interoperable logic devices. If implemented in software, the techniques may be realized at least in part by a non-transitory computer-readable storage medium comprising instructions that, when executed, perform one or more of the methods described above. The non-transitory computer-readable storage medium may form part of a computer program product, which may include packaging materials.

The non-transitory processor-readable storage medium may include random access memory (RAM) such as synchronous dynamic random access memory (SDRAM), read only memory (ROM), non-volatile random access memory (NVRAM), electrically erasable programmable read-only memory (EEPROM), FLASH memory, other known storage media, and the like. The techniques additionally, or alternatively, may be realized at least in part by a processor-readable communication medium that carries or communicates code in the form of instructions or data structures and that can be accessed, read, and/or executed by a computer or other processor.

The various illustrative logical blocks, modules, circuits and instructions described in connection with the embodiments disclosed herein may be executed by one or more processors. The term "processor" as used herein may refer to any general purpose processor, conventional processor, controller, microcontroller, and/or state machine capable of executing scripts or instructions of one or more software programs stored in memory.

FIG. 1A is a block diagram of an electronic system 100 having an LDO regulator 102 in combination with a delayed digital sleep signal generator 140, in accordance with some embodiments.

As shown, the LDO section 160 includes a pass element 110 and an error amplifier 120. The LDO section 160 receives an input voltage $V_{in}$ and produces an output voltage $V_{out}$ using a reference voltage $V_{ref}$. The input voltage $V_{in}$ may be a direct current (DC) voltage from a battery (not shown for simplicity) or other power supply. The LDO regulator 102 regulates the output voltage $V_{out}$ to a fine degree of precision using a regulation loop 101 and other circuitry to compare reference voltage $V_{ref}$ to output voltage $V_{out}$. The LDO regulator 102 does so by changing the value of a capacitive load 150, coupled to the output of the LDO section 160, such that the output voltage $V_{out}$ is maintained at a constant desired value. The error amplifier 120 adjusts the output current $I_{out}$ in response to changes in the capacitive load 150 to maintain the value of output voltage $V_{out}$ at the constant desired value.

The LDO regulator 102 may produce the output voltage $V_{out}$ based, at least in part, on the received input voltage $V_{in}$. The power supply itself, and/or circuitry that is connected to input voltage $V_{in}$ may introduce ripple or other small voltage variations. However, using the error amplifier 120, the LDO regulator 102 may be configured to maintain the output voltage $V_{out}$ at a substantially stable voltage level even in the presence of voltage variations in the input voltage $V_{in}$. More specifically, the LDO regulator 102 may provide a variable output current $I_{out}$ to an external load (such as a processor or other circuitry with a variable resistance and/or capacitance) while maintaining a relatively steady level of output voltage $V_{out}$ across the load.

The pass element 110 may have a variable resistance (or capacitance) that is adjustable via a control voltage $V_{ctrl}$. More specifically, the control voltage $V_{ctrl}$ may control a voltage drop across the pass element 110. For example, in some implementations, the pass element 110 may include one or more metal-oxide semiconductor field-effect transistors (MOSFETs), such as PMOS transistors and/or NMOS transistors. In some other implementations, the pass element 110 may include one or more bipolar junction transistors (BJTs), such as NPN transistors and/or PNP transistors.

The pass element 110 includes a ballast device (e.g., ballast0) that provides a capacitance when activated. The pass element 110 may also include a plurality of additional ballast devices (e.g., ballast1, ballast2, . . . , ballastN) to provide further capacitance when activated. One or more ballast devices (e.g., ballast0, ballast1, ballast2, . . . , ballastN) is controlled by ballast switching circuits (e.g., BSC1, BSC2, . . . , BSCN of the error amplifier 120). By activating some of the ballast devices in certain time periods, and by activating other ballast devices in other time periods, multiple power conservation modes can be implemented. Table 1 depicts one scenario for multiple power saving modes.

TABLE 1

Example Power Modes

| Power Mode | Current | Ballast Devices |
|---|---|---|
| Active (normal operation) | 20 mA | All ballast devices are activated. |
| Sleep (temporarily dormant) | 5 mA | Only sleep mode ballast devices are activated. |

TABLE 1-continued

| Example Power Modes | | |
|---|---|---|
| Power Mode | Current | Ballast Devices |
| Hibernate (longer dormancy) | Leakage current | Only sleep mode ballast devices are activated. Supply voltage is reduced. |

As shown in Table 1, the current consumed by downstream circuitry of the electronic system 100 when in an active mode might be many times greater than the current consumed by downstream circuitry when in a sleep or hibernate mode. As such, when transitioning between modes, there can be large changes in the output current $I_{out}$. When the ballast is not controlled during switching transitions, large changes in output current $I_{out}$ (e.g., by a factor of 4 or more) may cause swings in the output voltage $V_{out}$. In some instances, the output voltage $V_{out}$ may oscillate below the brownout voltage level of downstream circuitry. As used herein, a brownout voltage level is that electrical potential below which electrical devices cease to operate as intended. For example, if a logic gate is designed for a 5V power supply, and the brownout voltage level is 3.3V, then the logic gate will operate as intended when the voltage to the logic gate is in the range of greater than 3.3V to 5V, however the logic gate may not reliably perform the intended logic function. Sequential circuits that store state information may lose their state information when operated below their brownout voltage level.

When circuits are powered by voltages that are below their respective brownout voltage levels, the circuits may reset themselves, lose state, produce unstable logic values, and the like.

One way to ameliorate the effects of brownout is to manage the oscillations in the output voltage $V_{out}$ to ensure that the voltage level does not oscillate below a brownout voltage. Techniques disclosed herein serve to control the ballast devices during transitions from one power mode to another power mode such that corresponding current level transitions do not cause wide voltage swings. Specifically, the ballast devices can be controlled during transitions from one power mode to another power mode through use of a series of power control signals that are generated in response to changing power mode inputs.

In electronic systems, transitions from one power mode to another power mode are made based on operating conditions of the electronic system 100 and/or its environment. Processing, or logic or other types of circuitry (not shown) produce one or more power mode signals 122A that are used by the power control section 170A. The power control section delivers the one or more power mode signals 122A as inputs to a delayed digital sleep signal generator 140 that generates a plurality of sleep signals corresponding to a given power mode. In the embodiment of FIG. 1A, the delayed digital sleep signal generator 140 generates sleep signals that are routed to circuitry of the LDO regulator 102. As the power mode signals 122A change between modes, the plurality of sleep signals corresponding to a changing power mode also change.

More specifically, when a power mode input changes value, the delayed digital sleep signal generator 140 generates a plurality of digital sleep signals, some of which are time-shifted copies of the power mode inputs. Using these time-shifted signals, ballast devices can be activated or deactivated in a gradual sequence. When the ballast devices are activated or deactivated in a gradual sequence, the voltage ripple during power transitions is small enough to ensure that the output voltage $V_{out}$ does not swing below the brownout voltage.

By controlling the ballast devices within the LDO regulator 102, any number of power modes that manage sequences of ballast device activation and deactivation can be implemented—even when the currents of the corresponding power modes vary significantly. The delayed digital sleep signal generator 140 may be implemented using discrete circuitry or processors or micro-sequencers or any combination thereof. When the power modes of the electronic system 100 change via additional circuitry or processes or state machines, etc. (not shown in FIG. 1A for simplicity), operational elements within the power control section 170A may generate ballast control signals 102 corresponding to such transitions. An illustrative set of power modes is now briefly shown and described as pertains to FIG. 1B.

Figure 1B:
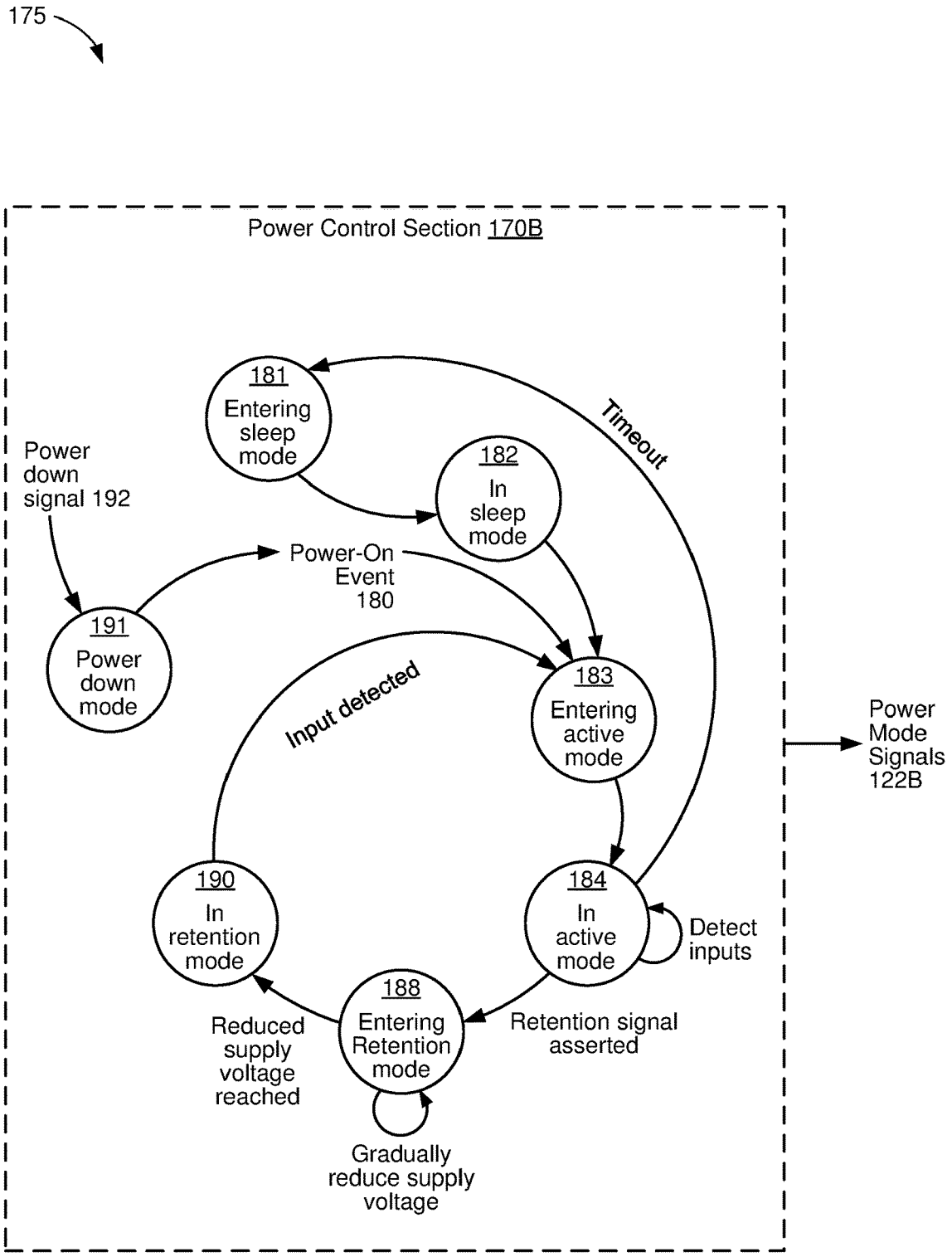
FIG. 1B depicts a power mode transition state diagram, in accordance with some embodiments.

FIG. 1B depicts a power mode transition state diagram 175, in accordance with some embodiments. The power mode transition state diagram 175 may be implemented by the power control section 170B to produce power mode indications (e.g., power mode signals 122B). The power mode transition state diagram 175 includes multiple power states 181-191, which may be entered or exited based on events and/or conditions. In the example of FIG. 1B, the power mode transition state diagram 175 includes transitions to and from a sleep mode 182, an active mode state 184, a retention mode state 190, and a power down mode 191. Additionally, transitions between these and other states are shown. In particular, upon a power on event 180, the power control section 170B is initialized before entering active mode state 183. When certain actions pertaining to entering sleep mode state 181 have been carried out (e.g., deactivating certain of the ballast devices of the LDO), the power control section 170B transitions to sleep mode 182, in which the current drawn by downstream circuits is small compared to the current drawn by downstream circuits when in active mode.

Operation in the sleep mode 182 persists until such time as an input is detected. Such an input can be from any source, possibly from an external source (e.g., a touch location sensor or a touch force sensor, or a proximity sensor, or a fingerprint sensor, etc.), or possibly from an internal source (e.g., from logic within the electronic system 100). Upon detection of such an input, the power control section 170B transitions to an entering active mode state 183, which transitions to the active mode state 184 when certain actions pertaining to the entering active mode state 183 have been carried out. In the active mode state 184, the power control section 170B may detect additional inputs (e.g., additional touch inputs or force inputs or proximity inputs, etc.).

As shown in FIG. 1B, there are two possible ways to transition out of active mode state 184. First, the active mode, circuits of the power control section 170B can process a timeout, whereby the power control section 170B determines that the power control section 170B has received no inputs for a prescribed period, at which time the state machine of the power control section 170B transitions to the entering sleep mode state 181. The second possibility for transitioning out of the active mode state 184 is to detect that a retention signal has been asserted, causing the power control section 170B to transition out of active mode state 184 into the entering retention mode state 188, whereupon the output voltage $V_{out}$ is gradually decreased so as to reduce power consumption by leakage currents. When the output voltage $V_{out}$ has been reduced at least to a prescribed reduced power supply voltage, power control section 170B may enter the retention mode state 190. The prescribed reduced power supply voltage that is maintained in retention mode state 190 until a transition out of the retention mode state 190 is a voltage level that is just high enough for electronic devices that are powered by the reduced power supply voltage to operate with known behavior. The prescribed reduced power supply voltage is higher than the brownout voltage of the electronic devices. Operation of the power control section 170B in the retention mode state 190 continues until transitioning out of the retention mode state 190, either upon detecting an input or upon detecting a power down signal 192. Specifically, when an input is detected, the power control section 170B transitions to the entering active mode state 183. When a power down signal 192 is detected, the power control section 170B transitions to the power down mode 191.

One of the functions of the power control section 170B is to produce power mode signals 122B, which may be used by a power control module to activate and/or deactivate ballast devices of the LDO section 160 so as to gradually increase an electrical load by adding ballast or to gradually decrease an electrical load by removing ballast when switching between higher current modes and lower current modes. As used herein, ballast is a combination of capacitance and/or inductance, and/or resistance or a combination thereof that is present in a circuit. Adding ballast can be accomplished by adding capacitance to a circuit. As an example, ballast can be added to a circuit by coupling a capacitor into a circuit. As another example, ballast can be added by coupling an electronic component that has inherent capacitance to a circuit such that when the electronic component is coupled to the circuit (e.g., by activating the electronic component) the capacitance of the circuit is greater than when the electronic component is not coupled to the circuit (e.g., by deactivating the electronic component).

A gradual addition of ballast or gradual removal of ballast (e.g., by coupling signals derived from the power control section 170B to ballast devices in the LDO section 160) serves to control ripples or swings in the output voltage $V_{out}$ of the LDO regulator 102 so that output voltage $V_{out}$ does not dip below the brownout voltage. One implementation of such a power control module is now shown and described with respect to the following FIG. 2A, FIG. 2B, and FIG. 2C.

Figure 2A:
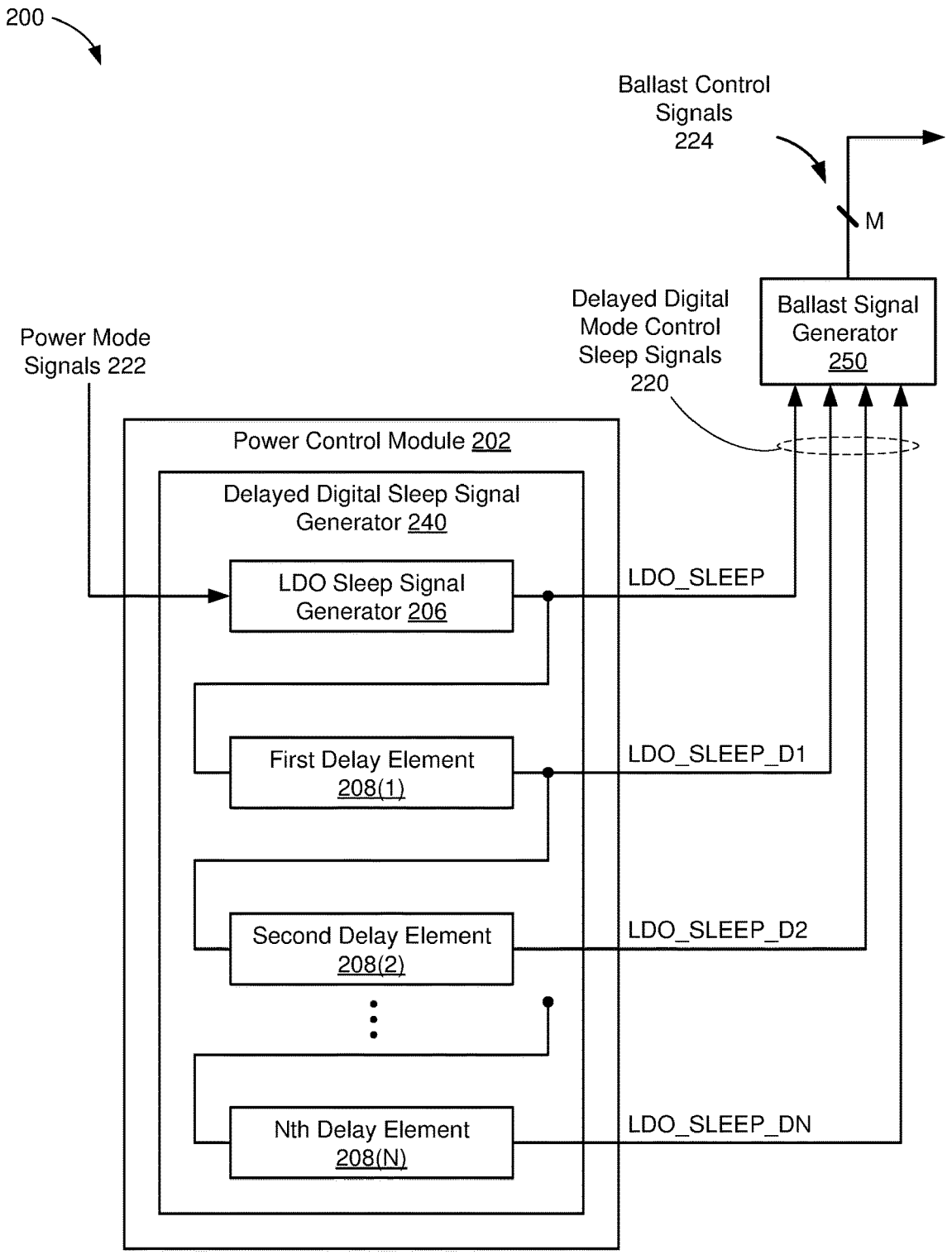
FIG. 2A is a block diagram of an example instance of a power control module, in accordance with some embodiments.

FIG. 2A is a block diagram of an example instance 200 of a power control module 202, in accordance with some embodiments. The power control module 202 converts power mode signals 222 that correspond to power mode signals 122A of FIG. 1A or to power mode signals 122B of FIG. 1B into a series of sequentially delayed digital signals, which are in turn used, directly or indirectly, to gradually (e.g., in successive time periods) turn on or turn off a series of ballast devices of an LDO. For example, upon receiving power mode signals 222 that change from a sleep logic state to an active logic state, the power control module generates successively delayed digital representations of the received power mode signals 222. In some embodiments, the values (e.g., logic values or voltages) of the received power mode indication signals 222 encode any number of power modes into a power mode indication. For example, a system having four distinct power states may encode the power states into two digital signals (e.g., two signals from the power mode signals 222) that indicate a powered-down power state, an active mode power state, a sleep mode power state and a retention mode power state.

To generate ballast control signals 224 that are used to add or remove ballast, the delayed digital sleep signal generator 240 receives power mode indication signals 222 and generates logic voltages that represent a Boolean '1' in one voltage range and a Boolean '0' in another voltage range. The logic voltages and delay elements are used to generate delayed digital mode control sleep signals 220 that are routed to a ballast signal generator 250. In this and other embodiments, the delayed digital sleep signal generator 240 uses an LDO sleep signal generator 206 to decode the power mode signals 222 to generate an LDO sleep signal (e.g., LDO_SLEEP). That LDO sleep signal is delayed a number of times, via delay elements 208(1)-208(N), to produce a number of delayed LDO sleep signals LDO_SLEEP_D1-LDO_SLEEP_DN, respectively.

The delayed digital mode control sleep signals 220 (e.g., LDO_SLEEP and LDO_SLEEP_D1-LDO_SLEEP_DN) are routed to the ballast signal generator 250. The ballast signal generator 250 converts the delayed digital mode control sleep signals 220 to ballast control signals 224. The voltages of the ballast control signals 224 may be different from the voltages of the delayed digital mode control sleep signals 220

Figure 2B:
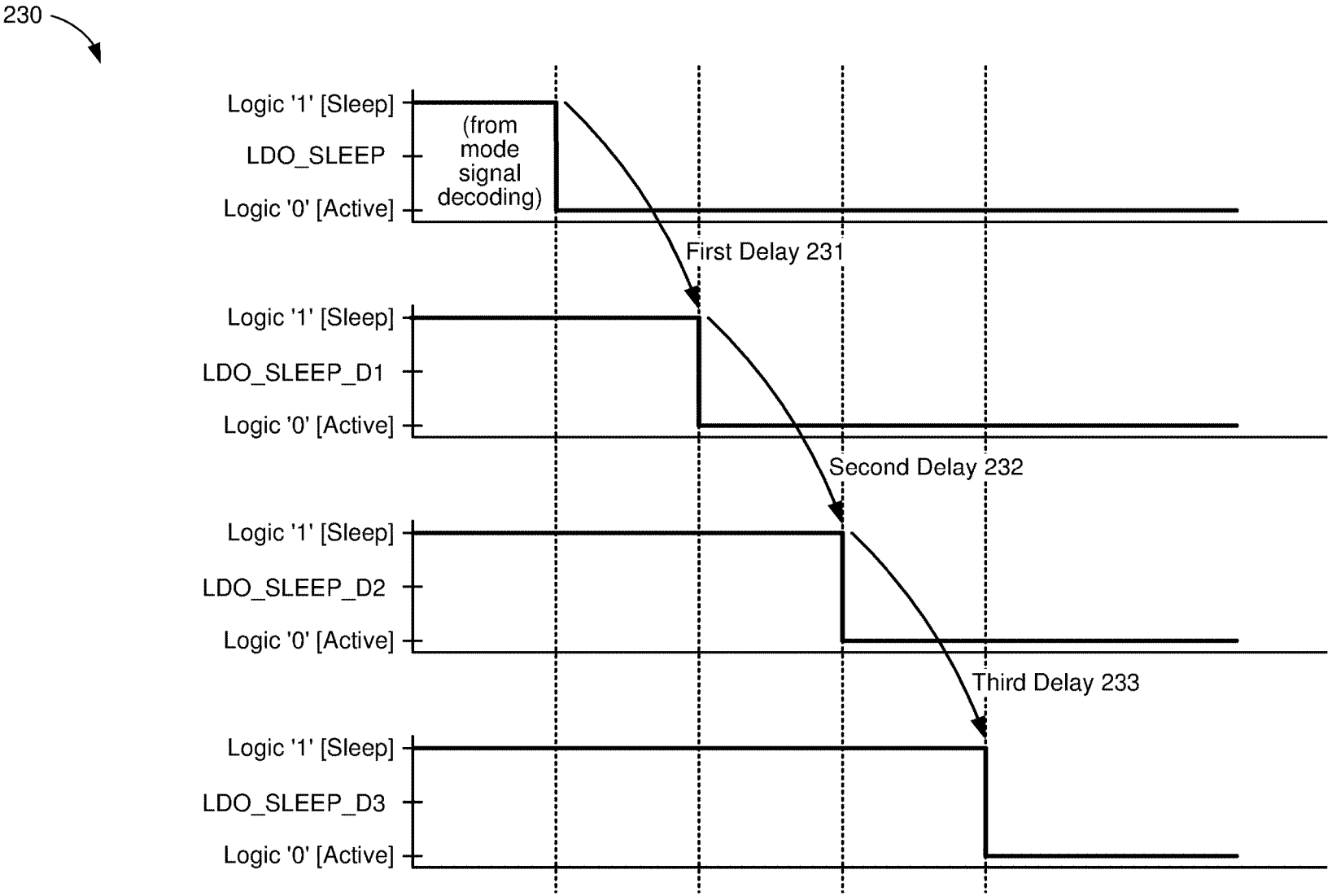
FIG. 2B is a timing diagram depicting a series of delayed digital mode control signals that may be output by a power control module, in accordance with some embodiments.

FIG. 2B is a timing diagram 230 depicting a series of delayed digital mode control signals LDO_SLEEP, LDO_SLEEP_D1, LDO_SLEEP_D2, and LDO_SLEEP_DN that may be output by a power control module, in accordance with some embodiments. The delayed digital mode control signals LDO_SLEEP and LDO_SLEEP_D1-LDO_SLEEP_DN may be example embodiments of the delayed digital mode control sleep signals 220 of FIG. 2A.

As shown, the sleep signals LDO_SLEEP_D1, LDO_SLEEP_D2, . . . , LDO_SLEEP_DN are time-shifted copies of LDO_SLEEP. A time-shifted copy of LDO_SLEEP may be generated by introducing a delay of a particular duration to LDO_SLEEP to generate LDO_SLEEP_D1. Additional time-shifted copies of LDO_SLEEP may be generated by cascading successive delays to respective previously delayed signals, or additional time-shifted copies of LDO_SLEEP may be generated by adding additional delays to LDO_SLEEP.

In the example of FIG. 2B, LDO_SLEEP_D1 may be generated by applying a first delay 231 to LDO_SLEEP, LDO_SLEEP_D2 may be generated by applying a second delay 232 to LDO_SLEEP_D1, and LDO_SLEEP_D3 may be generated by applying a third delay 233 to LDO_SLEEP_D2. In some embodiments, the second delay 232 is of the same duration as the first delay 231, and the third delay 233 is of the same duration as the first delay 231, etc., however any of the delays can be different from any other delay. In some cases, load shaping can be facilitated by establishing different delays. For example, a first delay might be longer than a second delay and so on.

The time-shifted copies of LDO_SLEEP (e.g., the sleep signals LDO_SLEEP_D1, LDO_SLEEP_D2, . . . , LDO_kSLEEP_DN) can be used to generate analog signals that are in turn used to add or remove ballast.

Figure 2C:
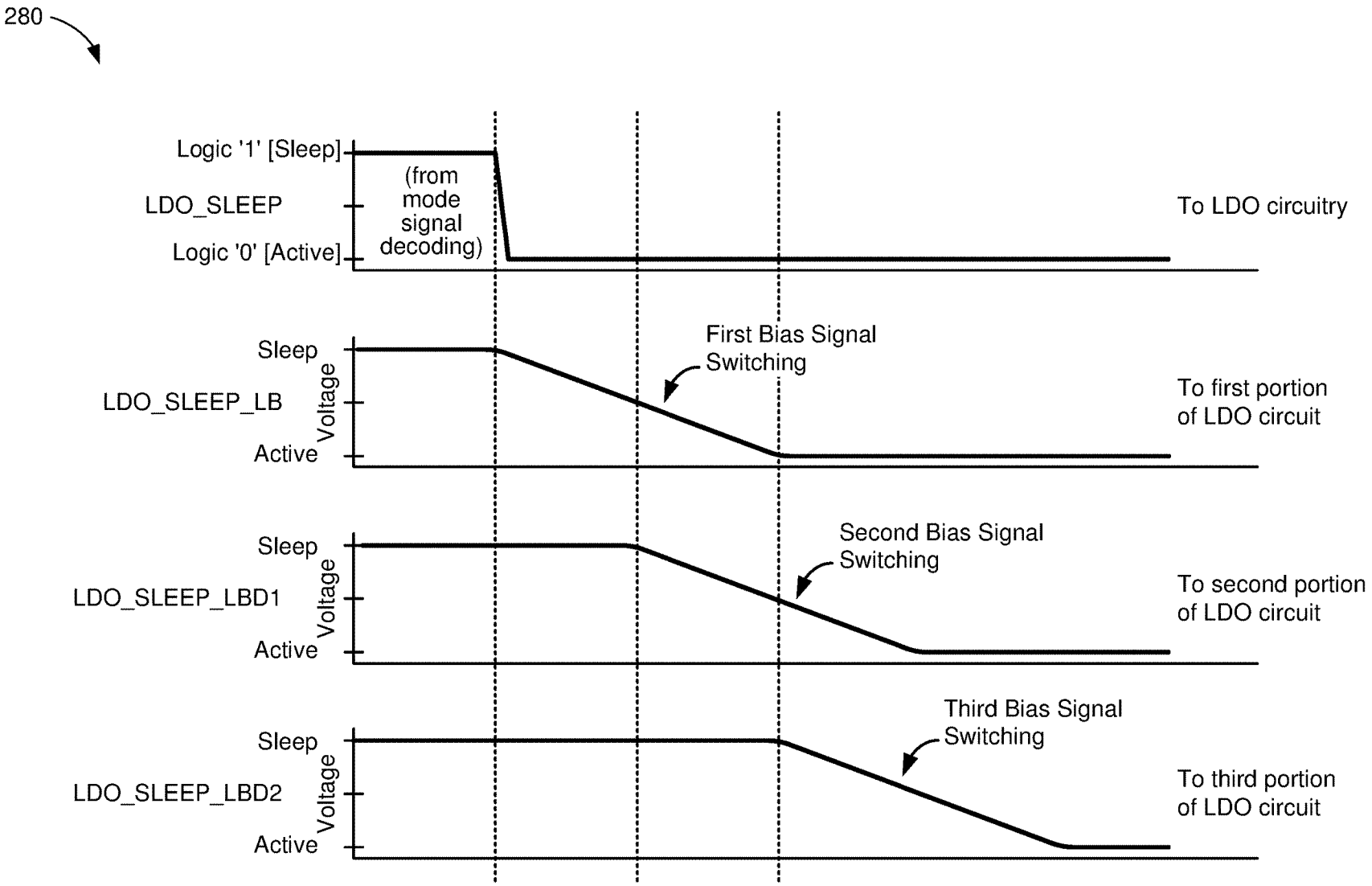
FIG. 2C is a timing diagram depicting a series of delayed analog mode control signals, in accordance with some embodiments.

The signals LDO_SLEEP and LDO_SLEEP_D1-LDO_SLEEP_DN are digital signals that are shown as ranging from a logic '0' level to a logic '1' level. However, in some implementations, the digital signals that range in voltage from a logic '0' level to a logic '1' may not be compatible with the voltage levels needed for controlling the pass elements and other components of LDOs. Accordingly, in some embodiments, a digital signal such as LDO_SLEEP_D1 may be converted into an analog signal that is better-suited for biasing ballast devices of the pass elements and other components of a given LDO. FIG. 2C depicts one such conversion.

FIG. 2C is a timing diagram 280 depicting a series of delayed analog mode control signals LDO_SLEEP, LDO_SLEEP_LB, LDO_SLEEP_LBD1, and LDO_SLEEP_LBD2, in accordance with some embodiments. As shown, a digital signal (e.g., LDO_SLEEP) is used to generate an analog signal (e.g., LDO_SLEEP_LB) that varies across a voltage range from a lower voltage corresponding to an active state to a higher voltage range corresponding to a sleep state. The example process may be performed for each of the delayed digital sleep signal LDO_SLEEP_D1-LDO_SLEEP_DN shown in FIG. 2B. The resulting analog signals (e.g., LDO_SLEEP_LB, LDO_SLEEP_LBD1, . . . , LDO_SLEEP_LBDN) may be routed to an LDO circuit, such as the LDO section 160 of FIG. 1A. More specifically, a first biasing signal LDO_SLEEP_LB is routed to a first portion of the LDO circuit (e.g., to a first ballast device), a second biasing signal LDO_SLEEP_LBD1 is routed to a second portion of the LDO circuit (e.g., to a second ballast device), a third biasing signal LDO_SLEEP_LBD2 is routed to a third portion of the LDO circuit (e.g., to a third ballast device), and so on.

The portions of the LDO circuit that are coupled to respective ballast devices (e.g., the first ballast device, the second ballast device, the third ballast device etc.) can depend on LDO design considerations. For example, the portions of the LDO circuit that are coupled to the respective ballast devices may include a pass device, an error amplifier, current management circuitry, and/or other functional portions of the LDO. One embodiment of an LDO that includes multiple ballast devices in different circuit subsections of an LDO is shown and described as pertains to FIG. 3.

Figure 3:
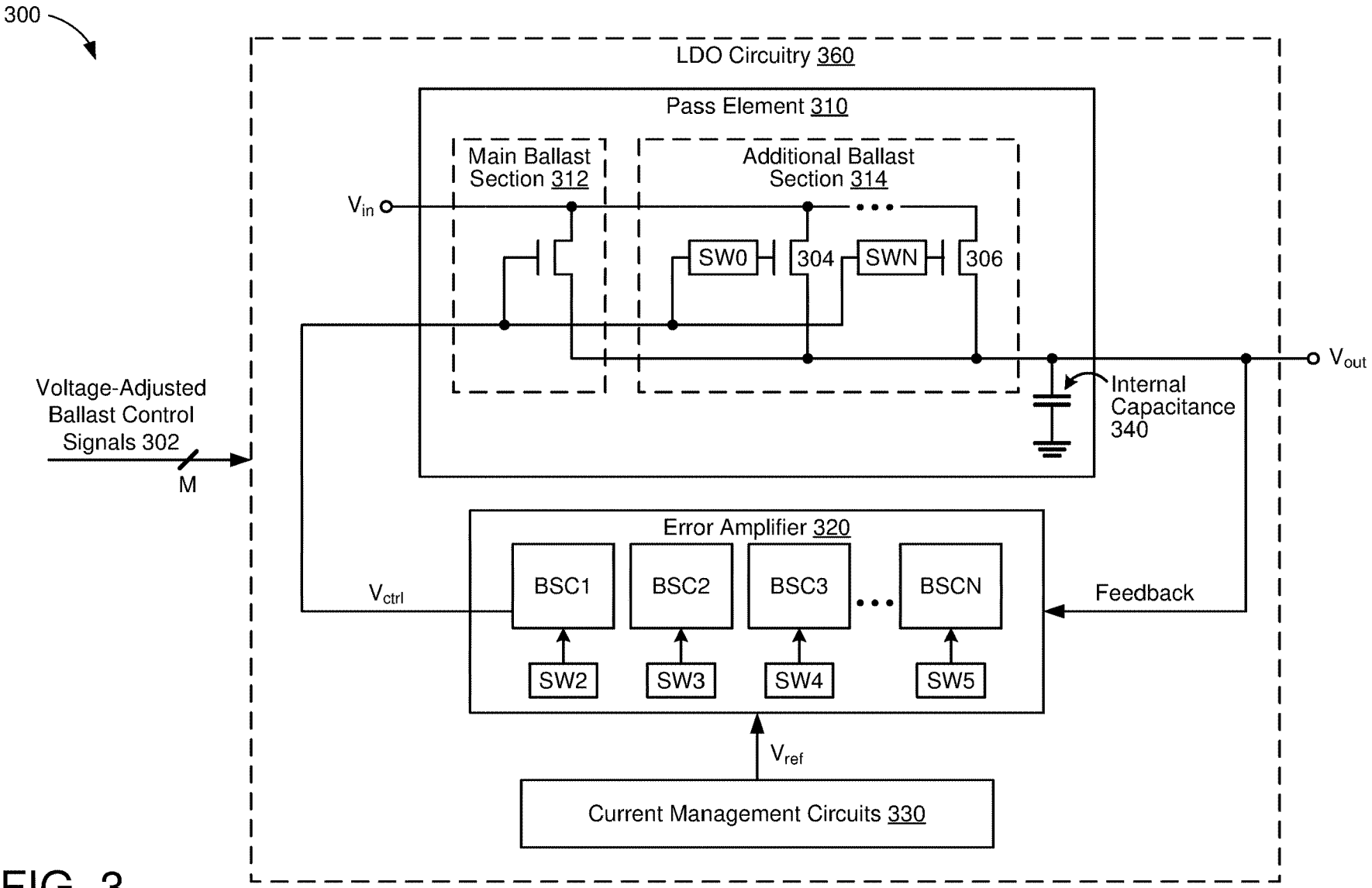
FIG. 3 is a block diagram of an example LDO circuit, in accordance with some embodiments.

FIG. 3 is a block diagram of an example LDO circuit 300. The LDO circuit 300 is shown to include LDO circuitry 360, which includes a pass element 310, an error amplifier 320, and current management circuits 330. The example LDO circuit 300 includes ballast switching circuits BSC1-BSCN, each of which is electrically coupled to a respective switch SW2-SW5.

The LDO circuitry 360 includes a plurality of switches (e.g., switch SW0, switch SW1, switch SW2, switch SW3, etc.) that are controlled by voltage-adjusted ballast control signals 302 (e.g., LDO_SLEEP_LB, LDO_SLEEP_LBD1, LDO_SLEEP_LBD2, LDO_SLEEP_LBDN, etc.). Specifically, voltage-adjusted ballast control signals 302 may be routed (not shown for simplicity) to the plurality of switches.

With reference for example to FIG. 2A, the voltage-adjusted ballast control signals 302 may correspond to the ballast control signals 224 generated by the ballast signal generator 250 and routed to the LDO circuitry 360.

As discussed with respect to the foregoing figures, a plurality of bias signals can be generated from successively delayed digital representations of the received digital mode signal. As such, the plurality of bias signals can be used to control successive additions (or subtractions) of ballasts from various portions of a voltage regulator.

In the example of FIG. 3, the pass element 310 includes a main ballast section 312 and an additional ballast section 314. The additional ballast section 314 includes a first additional ballast device 304 controlled by switch SW0 as well as a second or Nth additional ballast device 306 controlled by switch SWN. The error amplifier 320 includes additional ballast devices shown as ballast2, ballast3, ballast4, and ballastN, which are controlled by switches SW2, SW3, SW4, and SW5, respectively. The switches SW0, SW1, SW2, SW3, SW4, and SW5 may serve to apply a voltage to corresponding ballast devices. In the example of FIG. 3, the voltage applied to a ballast device when switched on is the control voltage $V_{ctrl}$. Furthermore, the control voltage $V_{ctrl}$ may be determined at least in part by a reference signal (e.g., the reference voltage $V_{ref}$ of current management circuits 330.

It is noted that, any number of successively delayed e.g., voltage-adjusted ballast control signals 302 can be used to gradually increase the capacitive load when transitioning the electronic system 100 from a lower load operating scenario (e.g., a sleep state) to a higher load operating scenario (e.g., an active state), for example, by successively coupling additional ballasts (e.g., 304, 306, etc.) to the output of the LDO circuit 300. As a result of gradually adding ballast during a transition from a lower load and lower current scenario to a higher load and higher current scenario, aspects of the present disclosure may prevent the output voltage $V_{out}$ from swinging down into a brownout voltage range.

In the embodiment of FIG. 3, the LDO circuit 300 includes current management circuits 330. Such current management circuits 330 can include ballast devices and corresponding switches (not shown for simplicity). As earlier indicated, an arbitrary number of successively delayed bias signals can be used to successively add ballast gradually, over time. As such, any number of ballast devices can be included within the current management circuits 330, and such additional ballast devices can be controlled by respective switches. Further, the current management circuits 330 as well as any other components within the LDO circuitry 360 may be configured based on a capacitance 340 of the LDO circuit 300 (e.g., as occurs in fully on-chip LDO implementations). The value of the capacitance 340 can vary depending on the particular packaging and on-chip semiconductor technologies involved. In cases of deep submicron semiconductor fabrication technologies, the internal capacitance might be in a range from 3 nF to 5 nF.

Figure 4:
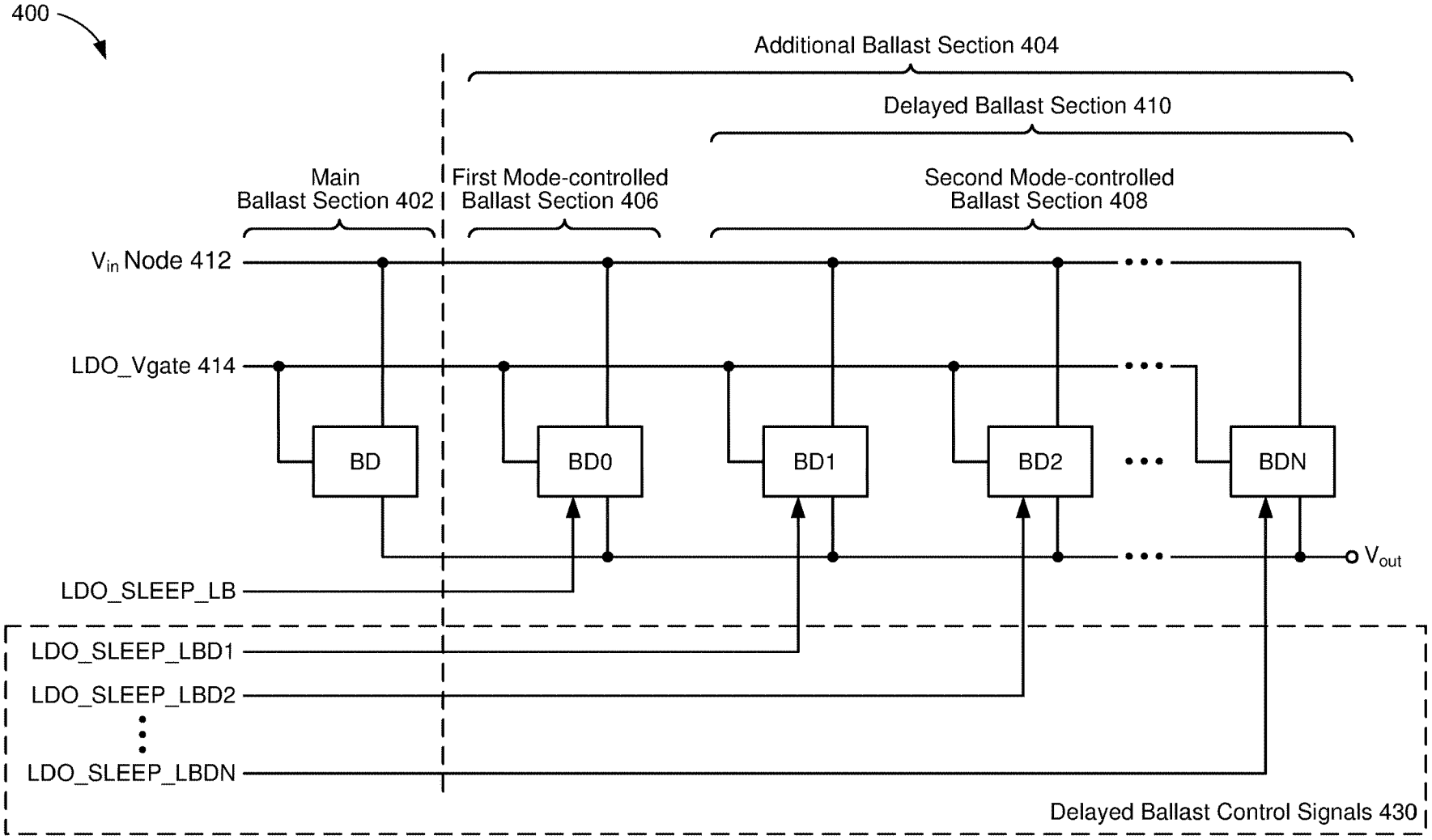
FIG. 4 is a block diagram depicting an example organization and interconnection of a plurality of ballast devices, in accordance with some embodiments.

FIG. 4 is a block diagram depicting an example organization and interconnection 400 of a plurality of ballast devices, in accordance with some embodiments. In the example of FIG. 4, ballast devices BD, BD0, BD1, BD2, . . . , BDN are organized into a main ballast section 402 and an additional ballast section 404. Each ballast device is electrically coupled to a power source (e.g., via $V_{in}$ node 412) as well as being electrically coupled a control voltage (e.g., LDO_Vgate 414). When a ballast device is activated, an electrical path that includes at least some capacitance is made between the power source and the node corresponding to output voltage $V_{out}$.

The main ballast section 402 and additional ballast section 404 may be example embodiments of the main ballast section 312 and additional ballast section 314, respectively, of FIG. 3. The additional ballast section 404 is composed of a first mode controlled ballast section 406 and a second mode-controlled ballast section 408. All or some of the ballast devices of the delayed ballast section 410 are controlled by delayed ballast control signals 430. During operation of a sleep-to-active transition, some or all of the ballast devices of the second mode-controlled ballast section 408 are switched on.

The main ballast section 402 includes a ballast device BD that is not connected to any of the delayed ballast control signals 430, and thus is not switched on or off in response to changes in delayed ballast control signals 430. Rather, the ballast device BD in the main ballast section 402 is controlled by other mechanisms so as to provide a minimum current (e.g., a quiescent current) regardless of changes in the mode control signals. The minimum current is often a fraction of the current drawn in a respective power mode. The minimum current is the minimum current needed for the linear portions of the voltage regulator and surrounding circuitry to operate. Table 2 depicts example quiescent currents (expressed in milliamps) as a function of a corresponding power mode.

TABLE 2

Example Quiescent Currents

| Power Mode | Current Draw in Operation | Minimum Quiescent Current |
|---|---|---|
| Active (normal operation) | 20 mA | ~0.04 mA |
| Sleep (temporarily dormant) | 5 mA | ~0.02 mA |
| Hibernate (longer dormancy) | Leakage current | ~0.01 mA (at lowered voltage) |

The additional ballast section 404 includes ballast device BD0, ballast device BD1, ballast device BD2, . . . , ballast device BDN that are controlled by respective mode control signals LDO_SLEEP_LB, LDO_SLEEP_LBD1, LDO_SLEEP_LBD2, LDO_SLEEP_LBDN.

The ballast devices BD0-BDN may include an embedded switch (not shown for simplicity). Moreover, the embedded switch or any other component may operate on positive logic assertion or negative logic assertion. In other words, a higher voltage on a mode control signal (e.g., LDO_SLEEP_LB) might decouple the corresponding ballast device from the signal corresponding to output voltage $V_{out}$, and a lower voltage on a mode control signal (e.g., LDO_SLEEP_LB) might couple the corresponding ballast device from the signal corresponding to output voltage $V_{out}$. Conversely, in another logic assertion scenario, a higher voltage on a mode control signal (e.g., LDO_SLEEP_LB) might couple the corresponding ballast device from the signal corresponding to output voltage $V_{out}$, and a lower voltage on a mode control signal (e.g., LDO_SLEEP_LB) might decouple the corresponding ballast device from the signal corresponding to output voltage $V_{out}$.

A ballast device can be implemented using any combination of digital and/or analog components. Moreover, any voltage conversions between digital circuitry and analog circuitry can be performed within a ballast device or can be performed in other portions of the electronic system 100. More particularly, a ballast device such as ballast device BD0, ballast device BD1, etc. can be implemented using any of the aforementioned devices that are used in a pass element. As such, various transistors, including metal-oxide semiconductor field-effect transistors (MOSFETs), or PMOS transistors or NMOS transistors can be used.

Figure 5A:
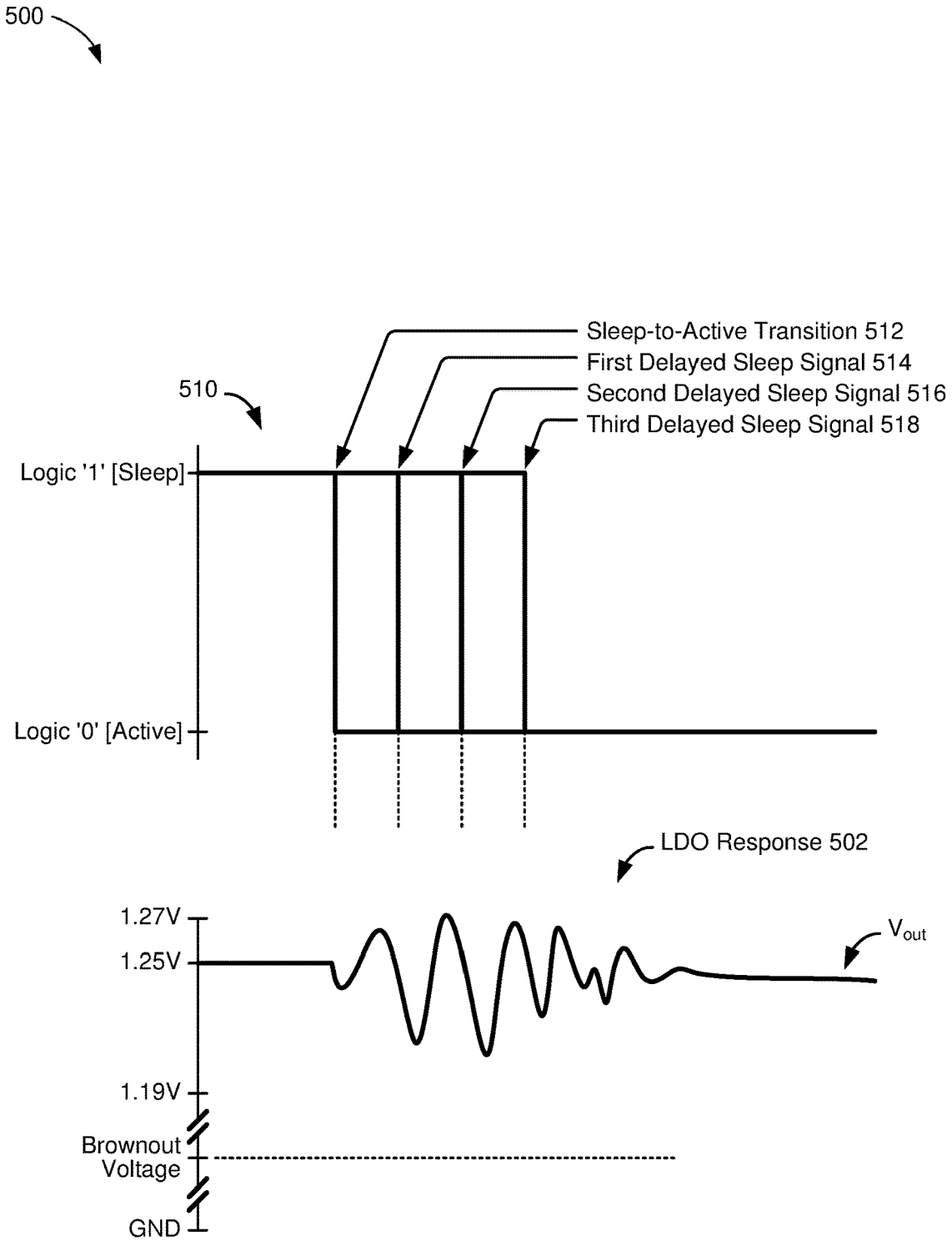
FIG. 5A shows an example LDO sleep-to-active response when successive additional ballast devices are activated by successively delayed ballast control signals in a sleep-to-active transition, in accordance with some embodiments.

FIG. 5A shows an example LDO sleep-to-active response 500 when successive additional ballast devices are activated by successively delayed ballast control signals in a sleep-to-active transition, in accordance with some embodiments. The top portion of FIG. 5A shows several digital waveforms 510 depicting signal transitions from logic '1' to logic '0' over a period of time. More specifically, the digital waveforms 510 include a digital sleep-to-active transition 512, a first delayed sleep-to-active transition 514, a second delayed sleep-to-active transition 516, and a third delayed sleep-to-active transition 518. As heretofore described, these signals 512-518 are converted into ballast bias signals, which in turn are used to control the activation or deactivation of ballast devices when transitioning from a sleep power mode (e.g., lower current operating mode) to an active power mode (e.g., higher current operating mode).

An LDO response 502 is shown in the lower portion of FIG. 5A. In this example, the analog waveform of output voltage $V_{out}$ is depicted in the lower portion of FIG. 5A as plotted on a voltage scale from zero volts (GND) to 1.27 volts. As shown in FIG. 5A, although the output voltage $V_{out}$ ripples slightly over time in response to the transition from lower current operation to higher current operation, the voltage ripple is within a narrow voltage range, well above the brownout voltage.

Figure 5B:
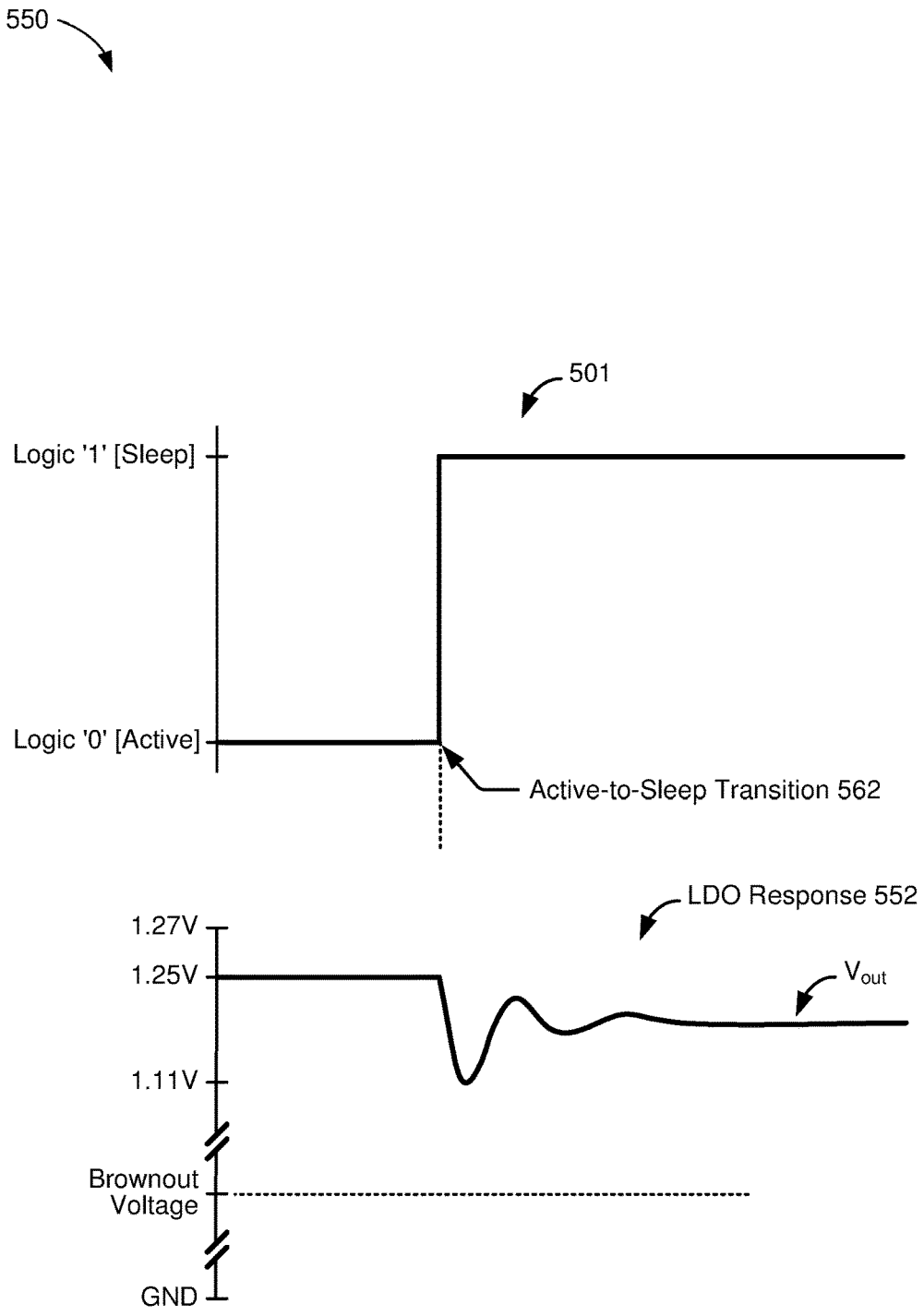
FIG. 5B shows an example LDO active-to-sleep response when successive additional ballast devices are deactivated by successively delayed ballast control signals in an active-to-sleep transition, in accordance with some embodiments.

FIG. 5B shows an example LDO active-to-sleep response 550 when successive additional ballast devices are deactivated by successively delayed ballast control signals that are generated based on an active-to-sleep transition 562, in accordance with some embodiments. The top portion of FIG. 5B depicts a digital waveform 501. Specifically, the digital waveform 501 transitions from logic '0' to logic '1' over a period of time. In some aspects, the digital waveform 501 may represent a digital power mode signal that transitions from an active state (e.g., logic '0') to a sleep state (e.g., log '1'). As heretofore described, such the digital waveform 501 may be converted into one or more ballast bias signals, which are in turn used to control the reduction of ballast when transitioning from an active power mode (e.g., higher current operating mode) to a sleep power mode (e.g., lower current operating mode).

An LDO response 552 is shown in the lower portion of FIG. 5B. In this example, the analog waveform of output voltage $V_{out}$ is depicted in the lower portion of FIG. 5B as plotted on a voltage scale from zero volts (GND) to 1.27 volts. As shown in FIG. 5B, although the output voltage $V_{out}$ ripples slightly over time in response to the transition from higher current operation mode to lower current operation mode, the voltage ripple is within a narrow voltage range, well above the brownout voltage.

Figure 5C:
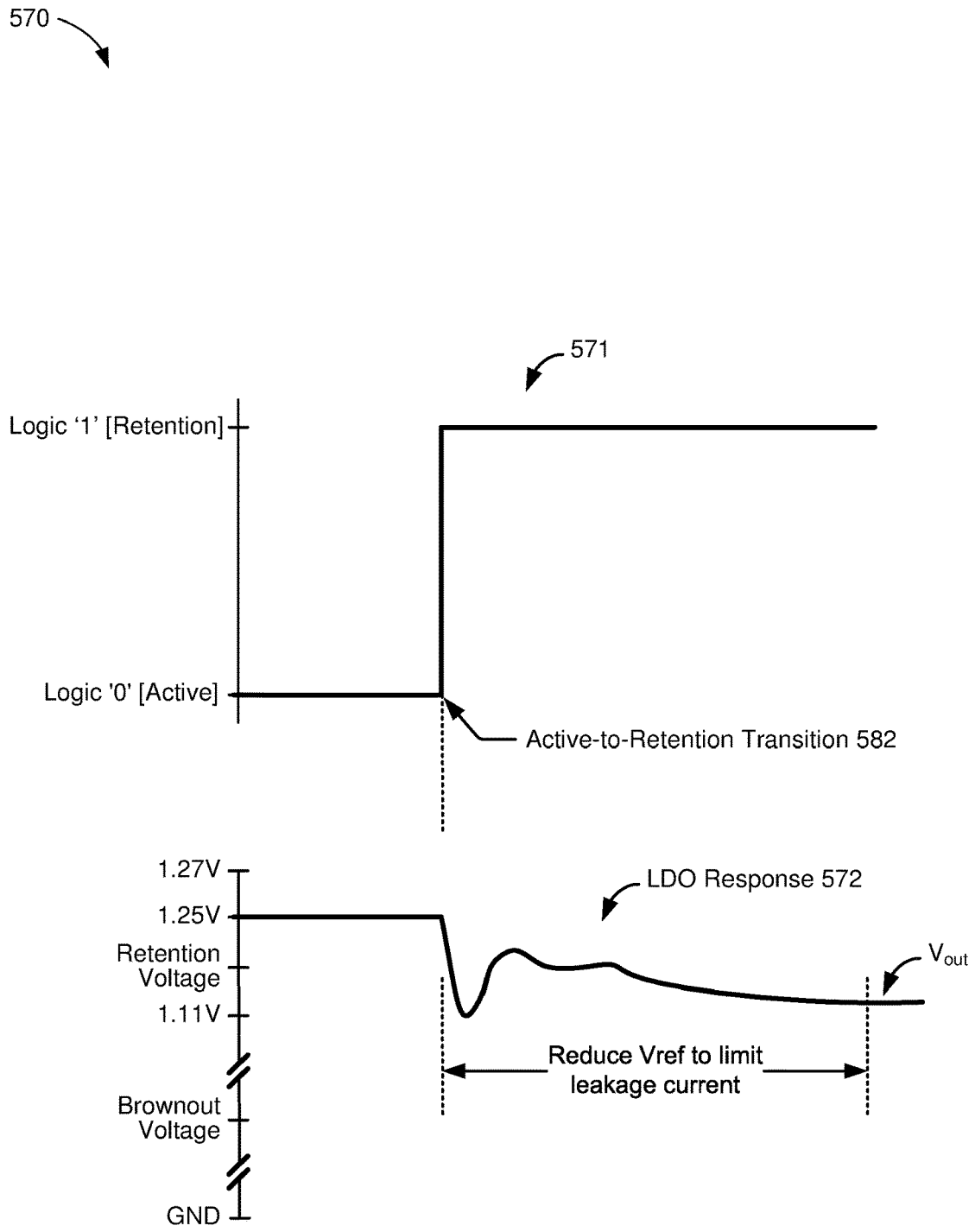
FIG. 5C depicts an example LDO active-to-retention mode scenario, in accordance with some embodiments.

FIG. 5C depicts an example LDO active-to-retention mode scenario 570 when successive additional ballast devices are deactivated by successively delayed ballast control signals based on an active-to-retention transition 582, in accordance with some embodiments. An LDO response 572 is shown in the lower portion of FIG. 5B.

A retention mode is a mode that is entered when higher-level logic determines that a period of inactivity is expected to be a long period. As such, in a retention mode, the voltage of the LDO can be reduced to further limit current draw during the retention period. The top portion of FIG. 5C depicts an active-to-retention signal 571 that transitions from logic '0' to logic '1' over a period of time.

As heretofore described, a digital active-to-retention signal 571 is converted into one or more ballast bias signals, which are in turn used to control the reduction of ballast when transitioning from an active power mode (e.g., higher current operating mode) to a sleep or retention power mode. As shown, the supply voltage is gradually reduced by decreasing reference voltage $V_{ref}$ contemporaneously with the gradual reduction of ballast. The gradual reduction of reference voltage $V_{ref}$ together with the gradual reduction of ballast may be performed during the transition from active mode to retention mode.

Figure 6:
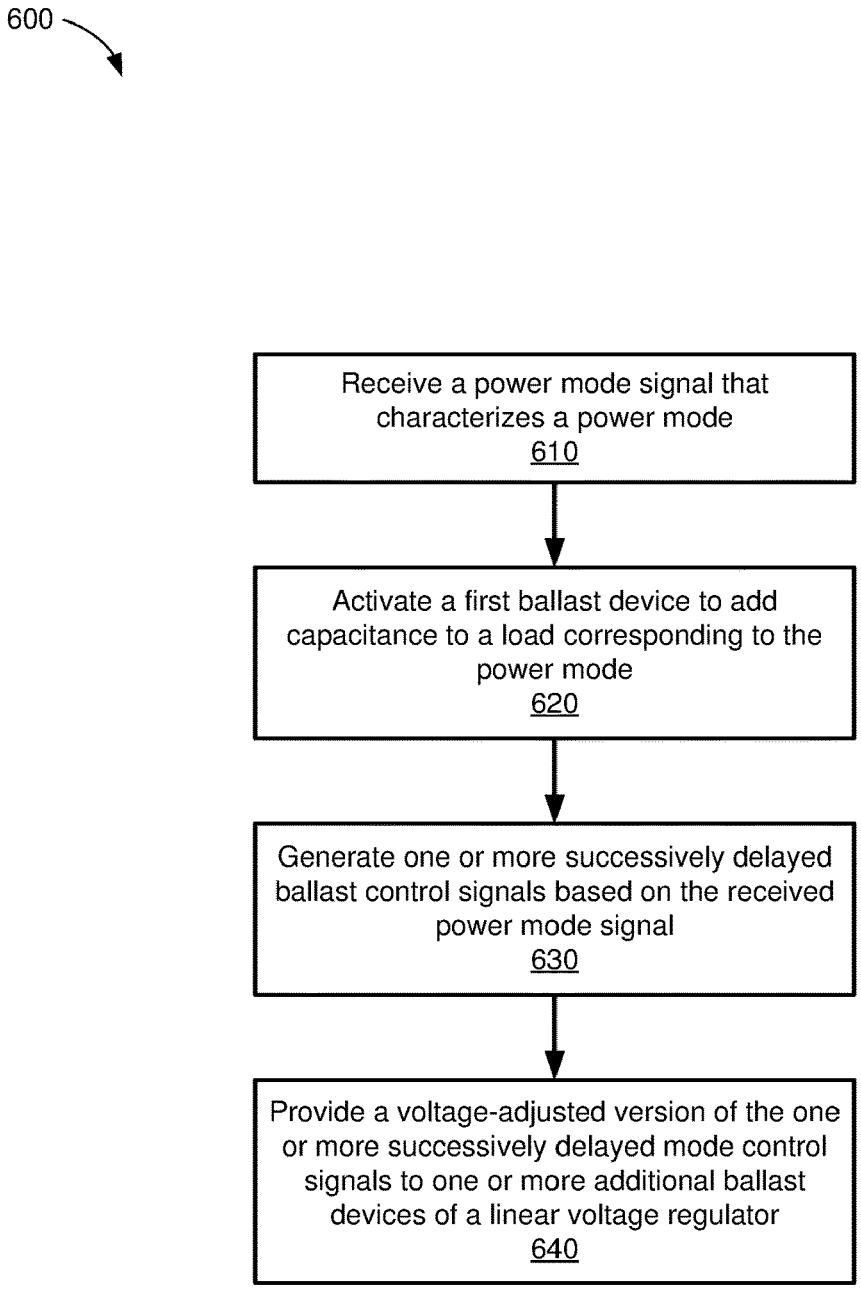
FIG. 6 is an illustrative flowchart depicting an example operation for managing successive ballast additions based on successively delayed mode control signals, in accordance with some embodiments.

FIG. 6 is an illustrative flowchart depicting an example operation 600 for managing successive ballast additions based on successively delayed mode control signals, in accordance with some embodiments. With reference for example to FIG. 1A and FIG. 3, the example operation 600 may be performed by portions of the electronic system 100 and/or the LDO circuit 300.

The electronic system 100 produces power mode signals 122A which are, in turn, received by other portions of the electronic system 100 (610). For example, a controller module of a touch sensor might implement a state machine to produce power mode signals 122A, which are received by an LDO of the electronic system 100.

The received signals are used to activate a first ballast device to add capacitance to a load corresponding to the power mode (620). In some aspects, the first ballast device is a first pass transistor of a pass element (e.g., as shown in FIG. 3). In other aspects, the first ballast device is a pass transistor of an error amplifier (such as the error amplifier 120 of FIG. 1). In some aspects, the pass element 110 and/or the error amplifier 120 may implement any one or more mechanisms to control a variable resistance (or capacitance) that is adjustable via a control voltage $V_{ctrl}$. In some implementations, the pass element 110 may be implemented by one or more metal-oxide semiconductor field-effect transistors (MOSFETs), such as PMOS transistors and/or NMOS transistors.

One or more additional ones of the received signals are used to generate one or more successively delayed ballast control signals (630). For example, a first delayed ballast control signal may be delayed by a first delay and a next successive delayed ballast control signal may be delayed by a second delay, and so on.

The successively delayed ballast control signals may be adjusted to provide a voltage-adjusted copy of respective, successively delayed ballast control signals (640). For example, when one or more of the received signals correspond to a logic voltage level (e.g., 3V or 5V, etc.) and/or when the one or more successively delayed ballast control signals correspond to a logic voltage level (e.g., 3V or 5V, etc.), those signals are converted to a voltage level that corresponds to the voltage level used for operation of the ballast devices.

Such voltage-adjusted copies of respective successively delayed ballast control signals are provided to ballast devices of an LDO (640). For example, if the received signals indicate a transition from an active state to a sleep state, the voltage-adjusted copies of respective successively delayed ballast control signals are routed to a number of ballast devices that will be gradually deactivated so as to prevent an output voltage from dipping below the brownout voltage.

Although specific embodiments have been described with respect to low voltage dropout voltage regulators, those of skill in the art will appreciate that the successive additions of ballast as disclosed herein may be applicable to other types of linear voltage regulators. Further, those of skill in the art will appreciate that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

Further, those of skill in the art will appreciate that the various illustrative logical blocks, modules, circuits, and algorithm steps described in connection with the aspects disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the disclosure.

The methods, sequences and/or algorithms described in connection with the aspects disclosed herein may be embodied directly in hardware, in a software module executed by a processor, or in a combination of the two. A software module may reside in RAM memory, flash memory, ROM memory, EPROM memory, EEPROM memory, registers, a hard disk, a removable disk, a CD-ROM, or any other form of storage medium known in the art. An exemplary storage medium is coupled to the processor such that the processor can read information from, and write information to, the storage medium. In the alternative, the storage medium may be integral to the processor.

In the foregoing specification, embodiments have been described with reference to specific examples thereof. It will, however, be evident that various modifications and changes may be made thereto without departing from the broader scope of the disclosure as set forth in the appended claims. The specification and drawings are, accordingly, to be regarded in an illustrative sense rather than a restrictive sense.

What is claimed is:

1. An electronic system, comprising:

a linear voltage regulator configured to regulate an output voltage, the linear voltage regulator including at least a first ballast device and a plurality of additional ballast devices that are configured to mitigate swings in the output voltage in response to receiving respective ballast control signals; and a power control module configured to:

receive a power mode indication having at least a first mode and a second mode; and produce the ballast control signals, in succession, in response to a change in the power mode indication, wherein each successive ballast control signal is delayed relative to when the change in the power mode indication occurs.

2. The electronic system of claim 1, wherein the first mode comprises an active mode and the second mode comprises a sleep mode.

3. The electronic system of claim 2, wherein a current drawn in the active mode is larger than a current drawn in the sleep mode.

4. The electronic system of claim 2, wherein a current drawn in a retention mode is smaller than a current drawn in the sleep mode.

5. The electronic system of claim 4, wherein the current drawn in the retention mode is reduced based at least in part on the output voltage of the linear voltage regulator being reduced in response to entering into the retention mode.

6. The electronic system of claim 1, further comprising at least one of a touch location sensor or a touch force sensor, or a proximity sensor, or a fingerprint sensor.

7. The electronic system of claim 1, wherein at least some of the ballast control signals comprise at least one first ballast control signal that is delayed by a first delay and at least one second ballast control signal that is delayed by a second delay, and wherein the second delay is longer than the first delay.

8. The electronic system of claim 1, wherein the linear voltage regulator is further configured to include a pass element having at least the first ballast device and having at least one of the plurality of additional ballast devices.

9. The electronic system of claim 1, wherein the linear voltage regulator is further configured to include an error amplifier having at least one of the plurality of additional ballast devices.

10. A method of operating three or more ballast devices of a linear voltage regulator, comprising:

producing a voltage at an output terminal that is electrically coupled to a first one of the three or more ballast devices;

receiving a power mode indication;

activating a first additional ballast device of the linear voltage regulator to add first additional capacitance to a load corresponding to the power mode;

generating one or more ballast control signals, in succession, in response to a change in the power mode indication, wherein each successive ballast control signal is delayed relative to when the change in the power mode indication occurs; and activating, using the one or more ballast control signals, second additional ballast devices of the linear voltage regulator to add second capacitances to the load of the linear voltage regulator.

11. The method of claim 10, wherein the power mode indication comprises at least an active mode and a sleep mode.

12. The method of claim 11, wherein a current drawn in the active mode is larger than a current drawn in the sleep mode.

13. The method of claim 11, wherein a current drawn in a retention mode is smaller than a current drawn in the sleep mode.

14. The method of claim 13, wherein the current drawn in the retention mode is reduced based at least in part on an output voltage of the linear voltage regulator being reduced in response to entering into the retention mode.

15. The method of claim 10, further comprising at least one of a touch location sensor or a touch force sensor, or a proximity sensor, or a fingerprint sensor.

16. The method of claim 10, wherein at least some of the one or more ballast control signals comprise at least one first ballast control signal that is delayed by a first delay and at least one second ballast control signal that is delayed by a second delay, and wherein the second delay is longer than the first delay.

17. A linear voltage regulator that varies a load on an output based on a change of power mode indication signals, the linear voltage regulator comprising:

LDO circuitry to receive, in succession, a plurality of ballast control signals in response to the change of power mode indication signals, wherein each successive ballast control signal is delayed relative to when the change of power mode indication signals occurs;

a pass element comprising at least one first ballast device and a plurality of additional ballast devices that are individually controlled by respective instances of the plurality of ballast control signals; and an error amplifier comprising at least one ballast control circuit that is coupled to at least one of the ballast control signals.

18. The linear voltage regulator of claim 17, wherein the power mode indication signals comprise at least an active mode and a sleep mode.

* * * * *